US012089755B2

(12) United States Patent
Hsieh et al.

(10) Patent No.: US 12,089,755 B2
(45) Date of Patent: Sep. 17, 2024

(54) MANNEQUIN

(71) Applicant: TG3D STUDIO INC. LIMITED, Hong Kong (CN)

(72) Inventors: Ho-Siang Hsieh, Hong Kong (CN); Lok Ting Wong, Hong Kong (CN); Kao Hing Paul Lee, Hong Kong (CN); Ka Ping Tsui, Hong Kong (CN)

(73) Assignee: TG3D STUDIO INC. LIMITED, Hong Kong (CN)

( * ) Notice: Subject to any disclaimer, the term of this patent is extended or adjusted under 35 U.S.C. 154(b) by 237 days.

(21) Appl. No.: 17/824,916

(22) Filed: May 26, 2022

(65) Prior Publication Data

US 2022/0378230 A1 Dec. 1, 2022

(30) Foreign Application Priority Data

May 28, 2021 (HK) ..... 32021031972.1

(51) Int. Cl.
*A47F 8/00* (2006.01)

(52) U.S. Cl.
CPC ..... *A47F 8/00* (2013.01)

(58) Field of Classification Search
CPC .... A41H 5/00; A41H 5/01; A41H 5/02; A47F 8/00; A47F 8/02; A63B 3/46
See application file for complete search history.

(56) References Cited

U.S. PATENT DOCUMENTS 2,632,586 A * 3/1953 Barrango ..... A47F 8/00 446/379
4,038,775 A * 8/1977 Sato ..... A63H 3/46 403/DIG. 1
4,545,514 A * 10/1985 Toy ..... A47F 8/02 223/66
5,265,779 A * 11/1993 Jiang ..... A41H 5/01 223/66
6,478,500 B1 * 11/2002 Farenholtz ..... F16C 11/10 623/59
6,485,215 B1 * 11/2002 Chiang ..... F16C 11/04 446/376
7,325,996 B2 * 2/2008 Varner ..... A63H 3/46 403/DIG. 1
8,684,783 B2 * 4/2014 Ehrsam ..... G09F 19/08 446/139
10,847,059 B2 * 11/2020 Tedeschi ..... G09B 23/32
2013/0186922 A1 * 7/2013 Soto Velasco ..... A47F 8/02 223/66

FOREIGN PATENT DOCUMENTS

CN 214230045 U * 9/2021

* cited by examiner

*Primary Examiner* — F Griffin Hall

(57) ABSTRACT

The present application discloses a mannequin. The mannequin includes: a torso, upper limbs on both sides of the torso and a yawing device used for regulating the lateral swing of the upper limb being arranged at the joint between the upper limb and the torso. An upper limb fixing seat is arranged at the root of the upper limb. The yawing device includes: a yawing bracket hinged with the top of the upper limb fixing seat and a regulating piece with an inner end movable relative to the bottom of the yawing bracket. The outer end of the regulating piece being fixedly connected with the yawing bracket, and the movement of the regulating piece is used to drive the top of the upper limb fixing seat to swing relative to the yawing bracket, such that the upper limb is driven to swing.

6 Claims, 15 Drawing Sheets

MANNEQUIN

TECHNICAL FIELD

The present application relates to the technical field of clothing design, and in particular to a mannequin.

BACKGROUND

Clothes customizing requires designers to tailor clothes according to the figure of specific customers. After the clothes have been well designed, details of the clothes need to be further adjusted according to the try-on effect of the customers, so as to ensure that the size and style of the customized clothes are perfectly matched with the customers.

In real life, both customers and costume designers are often busy, and it is difficult to realize multiple times of on-site try-on. Some well-known costume designers even accept the commission of a large number of foreign customers, which makes on-site try-on more difficult. If a designer cannot create the ideal condition where the customers can try on the clothes at any time, then it will inevitably make the designer fail to do his/her best objectively, and it is difficult for the customers to get clothes that fit perfectly with their own figures. Therefore, the mannequin with adjustable length and circumference came into being, and gradually became an indispensable prop for costume designers and clothing exhibitions.

However, most regions of the body surface of this type of mannequin are all immobile injection-molded parts, and only the abdomen or chest and other prominent parts are provided with a movable plate. Thus, in the adjustment of the circumference of the mannequin, the movable plate will obviously protrude or sink from other parts and thus cannot smoothly join with these other parts to form a smooth curve, which results in an abrupt overall contour of the mannequin and serious distortion of the visual effect.

SUMMARY

The embodiment of the present application provides a mannequin. The mannequin includes: a support frame for supporting the torso of the mannequin, one end of the support frame being located inside the torso: plates, being arranged at the periphery of the support frame, and being configured to enclose the shell of the torso, and comprising driving plates capable of actively moving in the direction away from or close to the support frame; circumference regulating devices, being arranged in the torso and fixedly connected with the support frame, and being configured to support the driving plate and driving it to move: the torso comprising a plurality of regulating regions provided with the driving plates, the plates further comprising driven plates capable of moving together with the driving plates when driven by the driving plates, and at least one of the regulating regions being provided with the driven plate.

Alternatively, the circumference regulating device is hinged with the driving plate.

Alternatively, a plurality of main regulating bands are distributed in the torso at intervals along the height direction thereof, each of the regulating regions at least includes one main regulating band, a plurality of the plates extending horizontally from one side of the torso to the other side are distributed in the main regulating band, the same main regulating band is provided thereon with at least two driving plates which are symmetrically distributed relative to the central axis of the human body: part of two adjacent main regulating bands among the main regulating bands are provided therebetween with an auxiliary regulating band linked with the main regulating bands, the auxiliary regulating band includes a plurality of the driven plates, and the driving plate on the main regulating band is hinged with the corresponding driven plate on the auxiliary regulating band.

Alternatively, at least part of the driven plates is hinged with two of the driving plates at the same time, and the part of the driven plates is at least hinged with one adjacent driving plate by a sliding hinge.

Alternatively, the sliding hinge includes a first hinge support and a second hinge support fixedly connected with the driving plate and the driven plate respectively, and a hinge rotating shaft connecting two of the first hinge support and the second hinge support, wherein the first hinge support or the second hinge support is provided with a sliding groove for the hinge rotating shaft to rotate and slide.

Alternatively, the first hinge support or the second hinge support is fixedly connected with the corresponding plate through a hinge fixing pin, and is capable of rotating relative to the hinge fixing pin.

Alternatively, the sliding groove is arranged on the first hinge support, and the first hinge support is rotationally connected with the driving plate through the hinge fixing pin.

Alternatively, the regulating regions include a chest region, a waist region, an abdomen region and a hip region respectively corresponding to the chest, waist, abdomen and hip of a human body, each of the four regions is respectively provided with a main regulating band, and an auxiliary regulating band is provided between every two adjacent regions among the four regions.

Alternatively, the back of the torso is provided with an auxiliary regulating band.

Alternatively, the regulating regions further include a back circumference region located at the back of the torso, the back circumference region includes a plurality of main regulating bands, and the auxiliary regulating band is arranged at the scapula of the mannequin.

Alternatively, the circumference regulating device includes a circumference transmission mechanism fixedly connected with the driving plate, and a circumference driving mechanism for driving the circumference transmission mechanism to operate: the circumference transmission mechanism includes a rack and a gear meshed with the rack, the outer end of the rack is fixedly connected with one of the driving plates corresponding thereto, and the circumference driving mechanism is configured to drive the gear to rotate.

Alternatively, the outer end of the rack is hinged with the corresponding driving plate.

Alternatively, each of the main regulating bands is at least provided thereon with two of the driving plates which are symmetrically distributed relative to the central axis of the torso and closest to the central axis of the torso, and the two racks for driving the two driving plates are respectively arranged on both sides of the central axis of the torso, and the two racks are capable of moving synchronously under the transmission of a gear set.

Alternatively, a plurality of circumference regulating and mounting tables corresponding to the plurality of regulating regions are arranged in the torso, and the circumference regulating device is arranged on the corresponding circumference regulating and mounting table.

Alternatively, the plurality of circumference regulating and mounting tables are sequentially distributed along the height direction of the torso, the circumference regulating and mounting tables are slidably connected with the support frame, and the torso is further provided therein with a lifting regulating device for regulating the circumference regulating and mounting tables to move up and down.

Alternatively, a lifting limit rod is further arranged between two adjacent circumference regulating and mounting tables, and the lifting limit rod is provided with a lifting limit mechanism for limiting the maximum interval and the minimum interval between the two adjacent circumference regulating and mounting tables.

BRIEF DESCRIPTION OF THE DRAWINGS

In order to more clearly explain the technical solutions of the embodiments of the present application, attached drawings required for the description of the embodiments of the present application will be briefly introduced hereinafter. Obviously, the attached drawings described below are only some of the embodiments of the present application, and other drawings can be obtained by those of ordinary skill in the art according to the attached drawings without any creative labor.

DETAILED DESCRIPTION

To facilitate the understanding of the present utility model, the present utility model will be explained in more detail with reference to the attached drawings and specific embodiments. It shall be noted that, when an element is expressed as "fixed" to another element, it may be directly on another element, or there may be one or more intervening elements therebetween. When an element is expressed as "connected" to another element, it may be directly connected to another element, or there may be one or more intervening elements therebetween. Terms such as "vertical", "horizontal", "left", "right" and other similar expressions used in this specification are for illustration purposes only.

Unless otherwise defined, all technical and scientific terms used in this specification have the same meanings as those commonly understood by those skilled in the art to which the present utility model belongs. In this specification, the terms used in the specification of the present utility model are only for the purpose of describing specific embodiments, and are not intended to limit the present utility model. The term "and/or" used in this specification includes any and all combinations of one or more associated items listed.

First Embodiment

Figure 1:
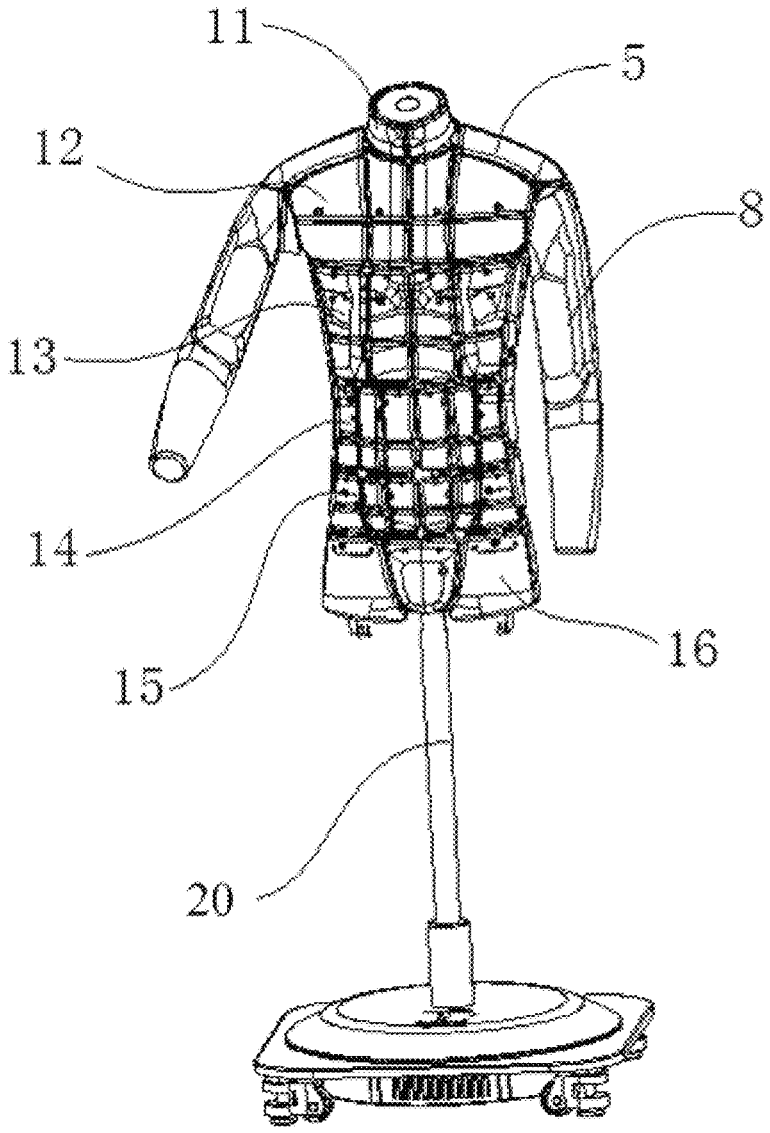
FIG. 1 is a schematic view of the overall structure of a mannequin in a first embodiment of the present utility model.
Figure 2:
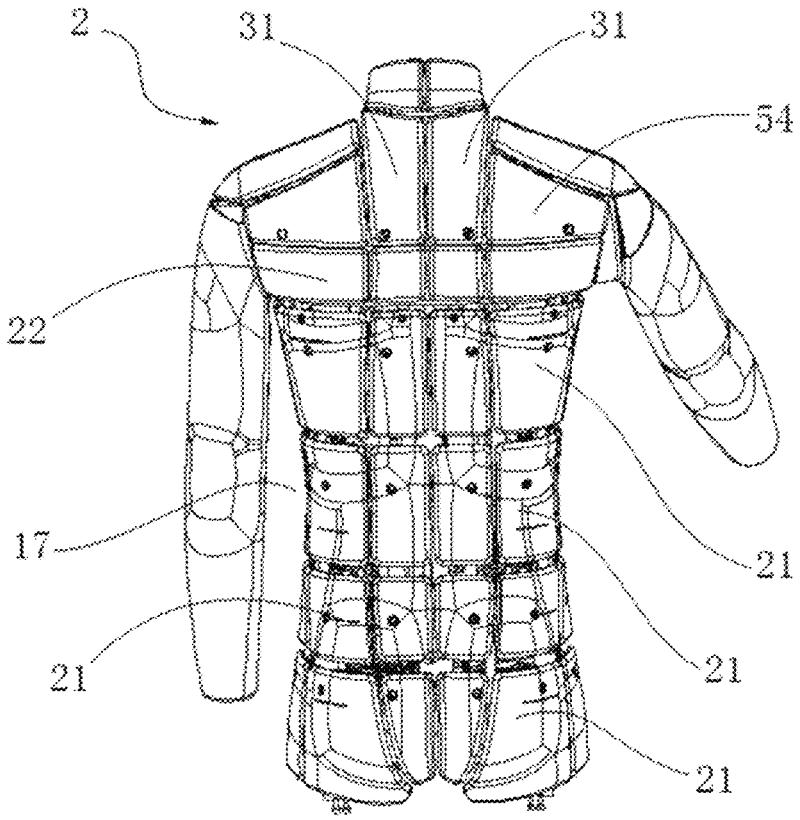
FIG. 2 is a schematic view of the back structure of the mannequin in the first embodiment of the present utility model.

This embodiment provides a mannequin. As shown in FIG. 1 and FIG. 2, the mannequin includes a neck region 11 and a torso 2 corresponding to a human body, and a support frame 20 for supporting the torso 2. The support frame 20 extends upward from the bottom of the torso 2 to the inside of the torso 2, and the bottom of the support frame 20 is further provided with a base which is convenient for standing upright. A plurality of plates are arranged on the periphery of the support frame 20, and these plates surround the support frame 20 to jointly form the shell of the torso 2.

The torso 2 is further provided therein with a plurality of groups of circumference regulating devices 4, and the circumference regulating devices 4 are used for driving circumference plates 3 to move in the direction away from or close to the support frame 20, thereby adjusting the circumference of the torso 2. The plates include the circumference plate 3 for regulating the size of the circumference of the torso 2 and a shoulder plate 5 for regulating the shape of the shoulder hump, wherein the circumference plate 3 may move in the direction away from or close to the support frame 20. The circumference plate 3 includes driving plates 31 and driven plates 32. The driving plate 31 is a plate that moves under the direct driving of the circumference regulating device 4. That is, instead of being moved through the transmission of other plates, the driving force of the driving plate 31 directly comes from the circumference regulating device 4. The driven plate 32 is movably connected with the driving plate 31, and the driven plate 32 cannot move actively; but can only move together with the driving plate 31 when driven by the driving plate 31. That is, the driven plate 32 is a plate that moves under the indirect driving of the circumference regulating device 4.

The torso 2 includes a plurality of regulating regions provided with the driving plate 31, and at least one of these regulating regions is provided with both the driving plate 31 and the driven plate 32.

Figure 3:
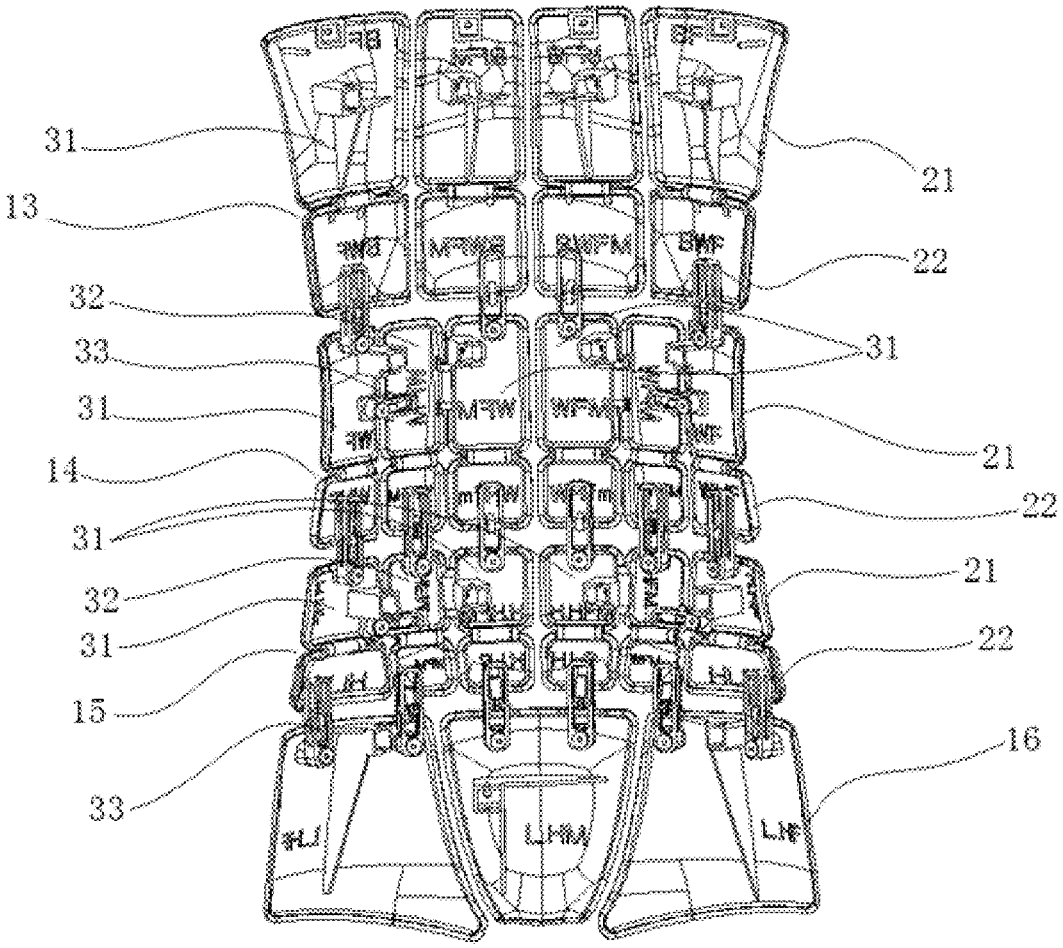
FIG. 3 is a view showing distribution of plates for chest, waist, abdomen and hip circumferences of the torso in the first embodiment of the present utility model.

As shown in FIG. 1 to FIG. 3, a plurality of main regulating bands 21 are distributed in the torso 2 at intervals along the height direction thereof, and each of the regulating regions includes at least one main regulating band 21, and the main regulating band 21 is covered with a plurality of circumference plates 3 extending horizontally from one side of the torso 2 to the other side. The same main regulating band 21 is at least provided thereon with two driving plates 31 which are symmetrically distributed relative to the central axis of the torso 2.

As shown in FIG. 2, the main regulating band 21 further includes two driving plates 31 closest to the central axis. Because the position closest to the central axis has the most important influence on the contour of the human body, in each main regulating band 21, the two circumference plates which are symmetrically distributed relative to the central axis of the torso 2 and closest to the central axis are all driving plates 31.

As shown in FIG. 3, part of two adjacent main regulating bands 21 are provided therebetween with an auxiliary regulating band 22 linked with the main regulating bands 21. The auxiliary regulating band 22 is arranged thereon with a plurality of circumference plates 3 extending horizontally from one side of the torso 2 to the other side. In this embodiment, the auxiliary regulating band 22 is completely made up of driven plates 32 arranged horizontally. The driving plate 31 on the main regulating band 21 is hinged with the corresponding driven plate 32 on the auxiliary regulating band 22. In other embodiments of the present application, the auxiliary regulating band 22 may also be formed by arranging part of the driving plates 31 and part of the driven plates 32 together.

As shown in FIG. 1 and FIG. 2, the regulating regions on the front of the torso 2 include a neck region 11, a cervicothoracic region 12, a chest region 13, a waist region 14, an abdomen region 15 and a hip region 16 which correspond to the neck part, chest-neck joint part, chest part, waist part, abdomen part, hip part and back part of the human body from top to bottom. The back of the torso 2 further includes a back circumference region 17 corresponding to the front of the torso. Because the front of the torso of the human body mainly includes the neck part, chest-neck joint part, chest part, waist part, abdomen part, and hip part, bones and muscles of these parts play the role of an overall framework. When the framework of these key parts is determined, other parts will form a natural and smooth curve according to the connecting lines. Therefore, the neck region 11, the cervicothoracic region 12, the chest region 13, the waist region 14, the abdomen region 15, and the hip region 16 are respectively provided with a main regulating band 21. Since the circumferences of the chest-neck joint part, chest part, waist part, abdomen part and hip part vary greatly among different people, areas between the cervicothoracic region 12, the chest region 13, the waist region 14, the abdomen region 15, and the hip region 16 need a larger adjustment space. Therefore, an auxiliary regulating band 22 is arranged between every adjacent two regions among the five regions.

As shown in FIG. 2, since the thickness of the back of the human body as well as whether it is hunchbacked or not will cause great differences in the outline of the scapula, the biggest difference in the back lies in the scapula. In order to exhibit shapes of hunchback, slouching, tough and stocky build or the like through adjustment, the back circumference region 17 of this embodiment also includes a plurality of main regulating bands 21, and an auxiliary regulating band 22 is arranged in the region where the scapula is located.

Figure 4:
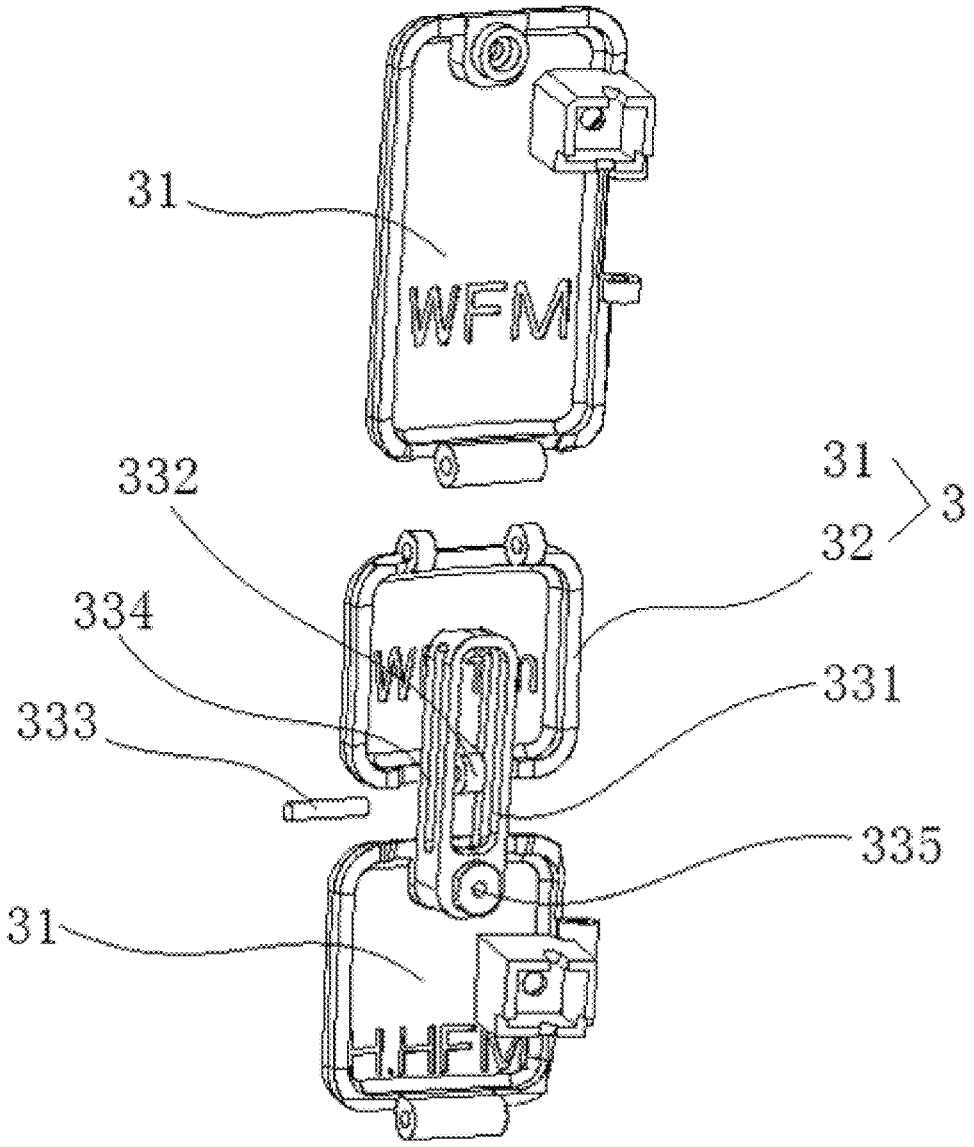
FIG. 4 is a schematic structural diagram of a sliding hinge in the first embodiment of the present utility model.

Specifically, as shown in FIG. 3 and FIG. 4, when the main regulating band 21 is arranged in a column with the corresponding circumference plates 3 on the adjacent auxiliary regulating band 22, the driven plate 32 of the column is hinged with two adjacent driving plates 31 which are respectively located above and below the driven plate 32. However, in order to truly simulate the muscle tissue of the human body, the sizes and shapes of the circumference plates 3 in different parts will be different. Thus, there will be cases where the circumference plates 3 in a certain region cannot form a complete column or a complete row, and some driven plates 32 can only be aligned with one driving plate 31 located above or below the driven plate 32. Such driven plate 31 is hinged in the vertical direction with the driving plate 31 that is aligned with it, and the side surface thereof is hinged with the circumference plate 3 that is adjacent to it.

For example, as shown in FIG. 3, because the waist circumference and abdomen circumference of human body vary greatly among individuals, the adjustable space of the mannequin corresponding to the waist region 14 and the abdomen region 15 is also large. Therefore, the two main regulating bands 21 where the waist region 14 and the abdomen region 15 are located further include passive plates 32, wherein two driving plates 31 are arranged on one side of the central axis of the torso 2, one of the two driving plates 31 is arranged closely adjacent to the central axis, and a passive plate 32 is arranged between the driving plate 31 and the other driving plate 31. The plates on both sides of the central axis of the torso 2 are symmetrically arranged, so the arrangement structure on the other side will not be further described herein.

When regulating the circumference of the torso 2, the distance between two driving plates 31 connected by the driven plate 32 will be enlarged or reduced according to the actual adjustment parameters. For example, when it is necessary to adjust the abdomen circumference to the shape of a pregnant woman, the middle of the abdomen will be raised high and the positions of both ends will remain unchanged, so that the curve of the whole abdomen will be lengthened and the distance between two driving plates 31 connected by one driven plate 32 will be widened. Therefore, it is necessary to have a certain space for change in the distance between the two driving plates 31. To solve this problem, in this embodiment, the passive plate 32 connecting two driving plates 31 at the same time is either connected with the driving plate 31 above it by a sliding hinge 33, or connected with the driving plate 31 below it by a sliding hinge 33, as shown in FIG. 4. That is, at least part of the driven plates 32 is movably connected with two driving plates 31 at the same time, and the part of the driven plates 32 is at least connected with one adjacent driving plate 31 by a sliding hinge 33.

As shown in FIG. 3 and FIG. 4, the sliding hinge 33 includes a first hinge support 331 fixed on the driving plate 31, a second hinge support 332 fixed on the driven plate 32, and a hinge rotating shaft 333 connecting the first hinge support 331 and the second hinge support 332. The first hinge support 331 or the second hinge support 332 is provided with a sliding groove 334 for the hinge rotating shaft 333 to rotate and move. To reduce the load on the driven plate 32 and improve the flexibility thereof, in this embodiment, the sliding groove 334 is provided on the first hinge support 331.

As the sliding hinge 33 is a composite hinge composed of a rotating pair and a moving pair, there are both a rotating pair capable of rotating relative to each other and a moving pair capable of moving relative to each other between the driven plate 32 and one of the driving plates 31, so that there is a certain space for change in the distance between two driving plates 31, and the two driving plates 31 can be rotationally connected with the driven plate 32 therebetween.

As shown in FIG. 4, the first hinge support 331 is fixedly connected with the driving plate 31 through a hinge fixing bolt 335, and the first hinge support 331 may rotate relative to the hinge fixing bolt 335. Because the hinge fixing bolt 335 and the hinge rotating shaft 333 are perpendicular to each other in space, the sliding hinge 33 is a spatial composite hinge formed by combining a coplanar plane rotating pair and moving pair and another non-coplanar plane rotating pair. In this way, the driving plate 31 and the driven plate 32 hinged by the sliding hinge 33 can also rotate in another plane perpendicular to the rotation plane, thereby providing a higher degree of freedom and greater flexibility for the driving plate 31 and the driven plate 32.

Figure 5:
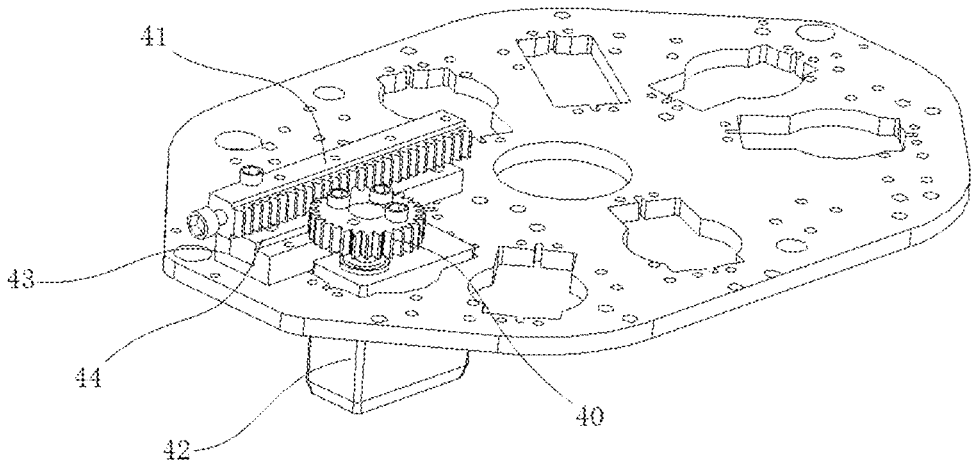
FIG. 5 is a schematic structural diagram of the circumference regulating device in the first embodiment of the present utility model.

As shown in FIG. 5, the circumference regulating device 4 includes a circumference transmission mechanism and a circumference driving mechanism, wherein the circumference transmission mechanism is fixedly connected with the driving plate 31, and the circumference driving mechanism is used for driving the circumference transmission mechanism to operate. In this embodiment, the circumference transmission mechanism includes a gear 40 and a rack 41 that are meshed with each other, and the circumference driving mechanism includes a circumference regulating motor 42, and a controller that controls the operation of the circumference regulating motor 42 according to instructions received. The output end of the circumference regulating motor 42 is in transmission connection with the gear 40 for driving the gear 40 to rotate.

Figure 6:
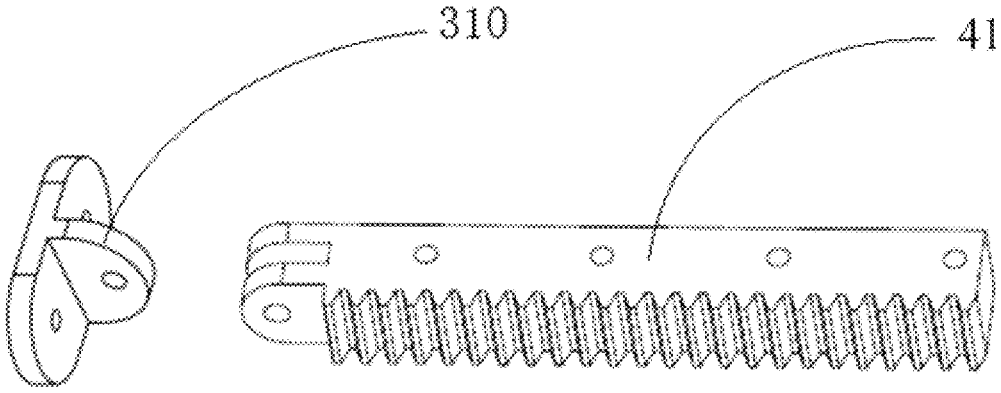
FIG. 6 is another schematic structural diagram of the circumference regulating device in the first embodiment of the present utility model.

As shown in FIG. 6, two racks 41 adjacent to the central axis of the torso 2 are arranged on both sides of the central axis of the torso, and are used to respectively fix the two driving plates 31 closest to the central axis of the torso 2. Because the regions of the human body that are on both sides of the central axis and nearest to the central axis must be symmetrical, the two racks 41 respectively used for driving the two driving plates 31 to operate can move synchronously under the transmission of a gear set 43.

As shown in FIG. 2, the torso 2 is provided therein with circumference regulating and mounting tables that respectively correspond to each of the regulating regions (the neck region 11, the cervicothoracic region 12, the chest region 13, the waist region 14, the abdomen region 15, and the hip region 16), and the circumference regulating devices 4 of each regulating region are fixedly arranged on the circumference regulating and mounting table, and the circumference regulating devices 4 are arranged in one-to-one correspondence with the driving plates 31 of the regulating region. Each regulating region on the front of the torso 2 is provided with a main regulating band 21, and the back of the torso 2 is correspondingly provided with a main regulating band 21. Therefore, each circumference regulating and mounting table is provided with a plurality of circumference regulating devices 4 corresponding to the front and rear sides of the torso 2. One end of the circumference regulating device 4 is centered on the support frame 20, and the other end thereof extends to the outside, and thus the circumference regulating devices 4 as a whole are distributed in a scattering manner.

As shown in FIG. 5, each circumference regulating device 4 includes a guide rail 43 fixed on the surface of the mounting table, and a slider 44 matched with the guide rail 43, and the slider 44 is fixedly connected with the bottom of the rack 41. The guide rail 43 extends from the inside of the torso 2 to the outside in the horizontal direction, the guide rail 43 is a groove-shaped guide rail, the slider 44 is located in the guide slot of the guide rail 43, and the slider 44 may slide along the guide rail 43. In this way, when the gear 40 rotates, it drives, via the rack 41, the slider 44 to move away from or close to the bracket along the guide rail. The end of the rack 41 is fixedly connected with the inner surface of the driving plate 31 by rack fastening bolts.

Of course, in other embodiments of the present application, the end of the rack 41 may also be hinged with the driving plate 31. As shown in FIG. 6, a third hinge support 310 is fixed on the inner side of the driving plate 31, and the third hinge support 310 is hinged with the end of the rack 41. With this structure, the driving plate 31 has the freedom to rotate in the vertical plane while moving along with the rack 41, so that it can rotate naturally according to the change of the surface curve of the mannequin, and keep its inclination angle consistent with the change of the surface curve of the mannequin. In this way, the outer contour of the mannequin is smoother, the line continuity is more natural, and the simulation degree is high.

Figure 7:
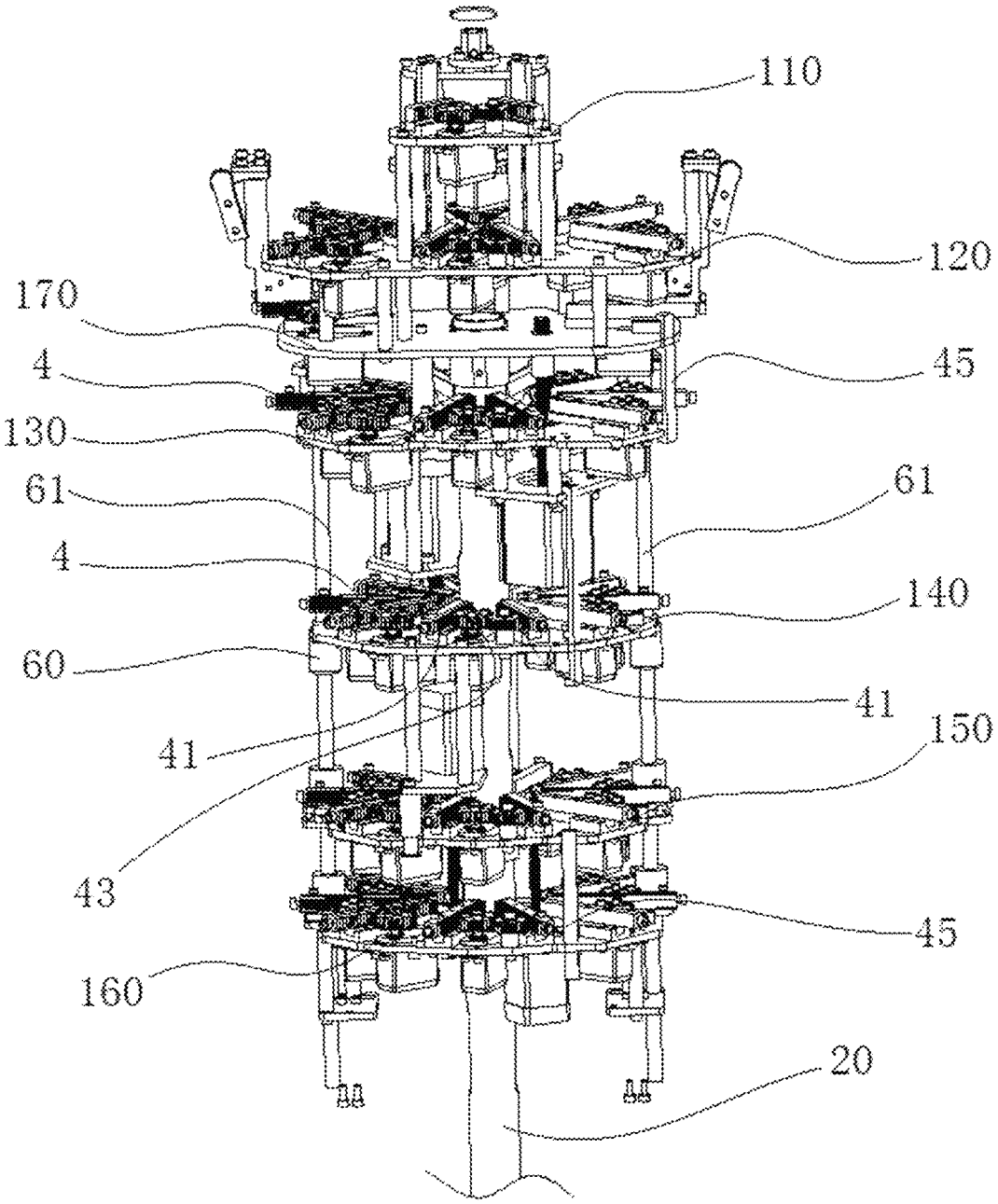
FIG. 7 is a schematic view showing the distribution of the circumference regulating devices in the first embodiment of the present utility model.
Figure 8:
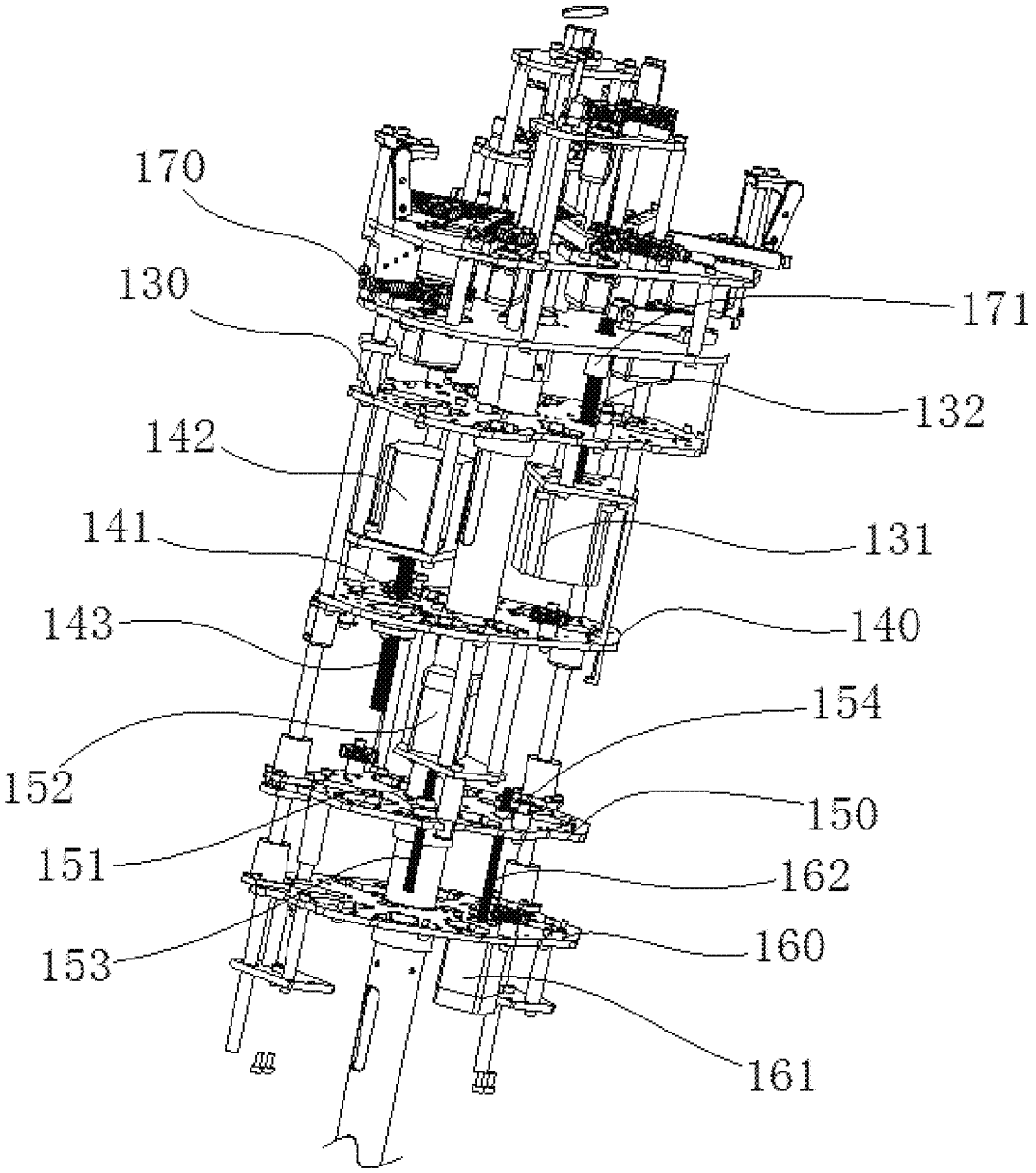
FIG. 8 is a schematic structural diagram of a lifting regulating device in the first embodiment of the present utility model.

As shown in FIG. 1. FIG. 7 and FIG. 8, the circumference regulating and mounting table includes a first mounting table 110, a second mounting table 120, a third mounting table 130, a fourth mounting table 140, a fifth mounting table 150 and a sixth mounting table 160, which respectively correspond to the neck region 11, the cervicothoracic region 12, the chest region 13, the waist region 14, the abdomen region 15 and the hip region 16. The support frame 20 sequentially passes through the sixth mounting table 160, the fifth mounting table 150, the fourth mounting table 140 and the third mounting table 130 from below. An upper limb regulating and mounting table 170 is further arranged between the second mounting table 120 and the third mounting table 130, and the end of the support frame 20 is fixedly connected with the upper limb regulating and mounting table 170. The sixth mounting table 160, the fifth mounting table 150, the fourth mounting table 140 and the third mounting table 130 are each fixedly provided with sliding bearings 60 on both sides and two optical axes 61 respectively passing through the sliding bearings 60 on both sides. The top of the optical axis 61 is further fixedly connected with the upper limb regulating and mounting table 170 and the second mounting table 120 respectively, and serves as a support column for the upper limb regulating and mounting table 170 and the second mounting table 120. The sixth mounting table 160, the fifth mounting table 150, the fourth mounting table 140 and the third mounting table 130 may slide along the optical axis 61 through the sliding bearings 60, so as to realize the up-and-down movement of each circumference regulating and mounting table.

Specifically, as shown in FIG. 8, the upper limb regulating and mounting table 170 is provided with a first screw nut 171, and the third mounting table 130 is fixedly provided thereon with a first lifting motor 131, and the output end of the first lifting motor 131 is provided with a first screw 132 matched with the first screw nut 171. The first lifting motor 131 drives the first screw 131 to rotate, thereby regulating the up-and-down movement of the third mounting table 130.

The fourth mounting table 140 is provided thereon with a second screw nut 141, the third mounting table 130 is fixedly provided thereon with a second lifting motor 142, and the output end of the second lifting motor 142 is provided with a second screw 143 matched with the second screw nut 141.

The second lifting motor 142 drives the second screw 143 to rotate, thereby regulating the up-and-down movement of the fourth mounting table 140.

The fifth mounting table 150 is provided thereon with a third screw nut 151, the fourth mounting table 140 is provided thereon with a third lifting motor 152, and the output end of the third lifting motor 152 is provided with a third screw 153 matched with the third screw nut 151. The third lifting motor 152 drives the third screw 153 to rotate, thereby regulating the up-and-down movement of the fifth mounting table 150.

The fifth mounting table 150 is provided thereon with a fourth screw nut 154, the sixth mounting table 160 is provided thereon with a fourth lifting motor 161, and the output end of the fourth lifting motor 161 is provided with a fourth screw 162 matched with the fourth screw nut 154. The fourth lifting motor 161 drives the fourth screw 162 to rotate, thereby regulating the up-and-down movement of the sixth mounting table 160.

Figure 9:
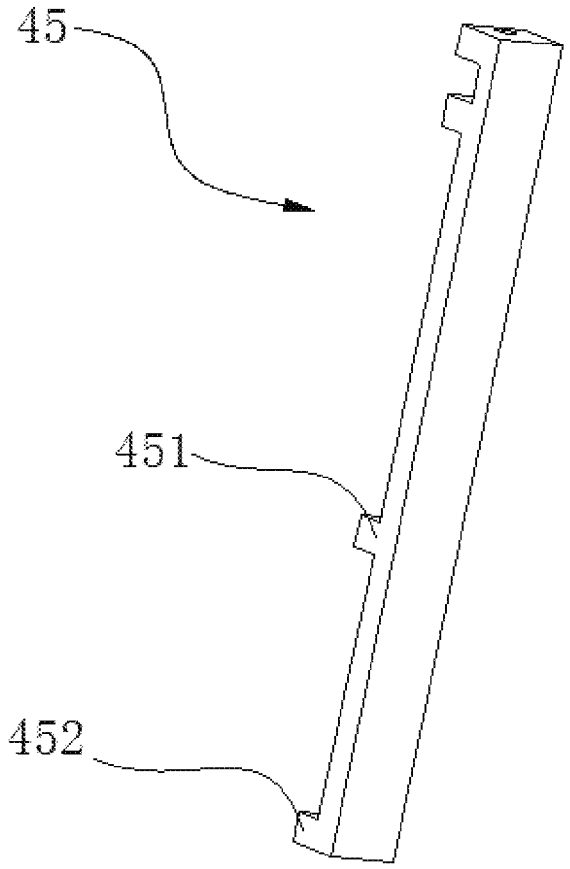
FIG. 9 is a schematic structural diagram of a lifting limit piece in the first embodiment of the present utility model.

As shown in FIG. 7 and FIG. 9, a lifting limit rod 45 is further arranged between two adjacent circumference regulating and mounting tables, one end of the lifting limit rod 45 is fixedly connected with one circumference regulating platform, the other end thereof passes through the adjacent circumference regulating and mounting table, and the end of the other end of the lifting limit rod 45 is provided with a lifting limit mechanism. The lifting limit mechanism includes a first limit protrusion 451 and a second limit protrusion 452 which are arranged at the other end of the lifting limit rod 45, wherein the first limit protrusion 451 and the second limit protrusion 452 are respectively located at two ends of the adjacent circumference regulating and mounting table, and a certain interval exists between the first limit protrusion 451 and the second limit protrusion 452. When the first limiting protrusion 451 or the second limiting protrusion 452 is attached to the surface of the adjacent circumference regulating and mounting table, the distance between the two circumference regulating and mounting tables reaches the maximum or minimum value. That is, the interval between the first limiting protrusion 451 and the second limiting protrusion 452 is the relative lifting stroke of two adjacent circumference regulating and mounting tables.

As shown in FIG. 7 and FIG. 9, taking two adjacent mounting tables, namely the sixth mounting table 160 and the fifth mounting table 150 (the sixth mounting table 160 corresponds to the hip region 16 and the fifth mounting table 150 corresponds to the abdomen region 15), as an example, the top end of the lifting limit rod 45 is fixedly connected with the fifth mounting table 150, and the bottom end thereof passes through the sixth mounting table 160 and may slide relative to the sixth mounting table 160. The lifting limit mechanism of the lifting limit rod 45 is located at one end near the sixth mounting table 160, the first limiting protrusion 451 is located above the sixth mounting table 160, and the second limiting protrusion 452 is located below the sixth mounting table 160. When the sixth mounting table 160 and the fifth mounting table 150 are moved up and down relative to each other and the first limiting protrusion 451 contacts the upper surface of the sixth mounting table 160, the distance between the sixth mounting table 160 and the fifth mounting table 150 reaches the minimum value: whereas when the second limiting protrusion 452 contacts the lower surface of the sixth mounting table 160, the distance between the sixth mounting table 160 and the fifth mounting table 150 reaches the maximum value. The lifting limit structures of the other two adjacent circumference regulating and mounting tables are the same as what described above, and thus will not be further described herein.

At least one advantage of the embodiment of the present application is as follows: since the regulating regions of the torso are a structure in which the driving plates and the driven plates are combined, the driving plates and the driven plates always move together, and when the driving plates move outwards, the driven plates can fill the gap between the driving plates, thereby maintaining the continuity of the contour curve of the torso, and achieving a high degree of simulation. The main regulating band drives the auxiliary regulating band to move synchronously so that one circumference regulating device can indirectly drive a plurality of plates to move at the same time, thereby reducing the difficulty of circumference adjustment, and meanwhile reducing the number of circumference regulating devices and simplifying the product structure.

Second Embodiment

Most of traditional mannequins have upper limbs that are fixedly connected with the torso and thus cannot move or rotate. In order to show the effect of more postures, the upper limbs of some existing mannequins are designed in such a way that they can swing back and forth relative to the body, but the upper limbs cannot swing laterally to the side of the body and the arms cannot be unfolded. Therefore, these mannequins cannot meet the simulation degree required by high-end clothing design, and furthermore, they cannot show multiple try-on effects of the clothing.

To solve this problem, this embodiment discloses a mannequin, which can achieve both the back-and-forth swing and the left-and-right lateral swing of the upper limbs. This embodiment may be used as an embodiment separately implemented, and it may also be used as an improved scheme of the first embodiment.

Figure 10:
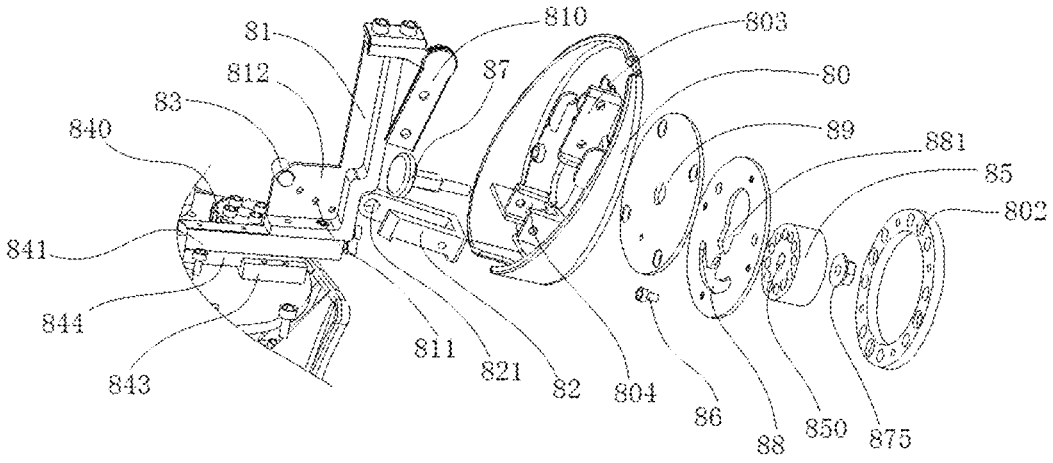
FIG. 10 is a schematic structural diagram of a yawing device and a pitching device in a second embodiment of the present utility model.

As shown in FIG. 10, the mannequin disclosed in this embodiment includes a torso 2 and upper limbs 8 located on both sides of the torso 2, the root of the upper limb 8 is provided with an upper limb fixing seat 80, and a yawing device is provided at the joint between the upper limb 8 and the torso 2. The yawing device is used to adjust the amplitude of the angle at which the upper limb 8 swings laterally to the side of the body. The yawing device includes a yawing bracket 81 fixed in the torso 2, and the top of the yawing bracket 81 is hinged with the top of the upper limb fixing seat 80. The yawing device further includes a regulating piece 82 with its inner end movable relative to the bottom of the yawing bracket 81, and the outer end of the regulating piece 82 is fixedly connected with the bottom of the yawing bracket 81. When the regulating piece 82 moves, it can drive the top of the upper limb fixing seat 80 to swing relative to the yawing bracket 81, thereby driving the upper limb 8 to swing laterally.

Figure 11:
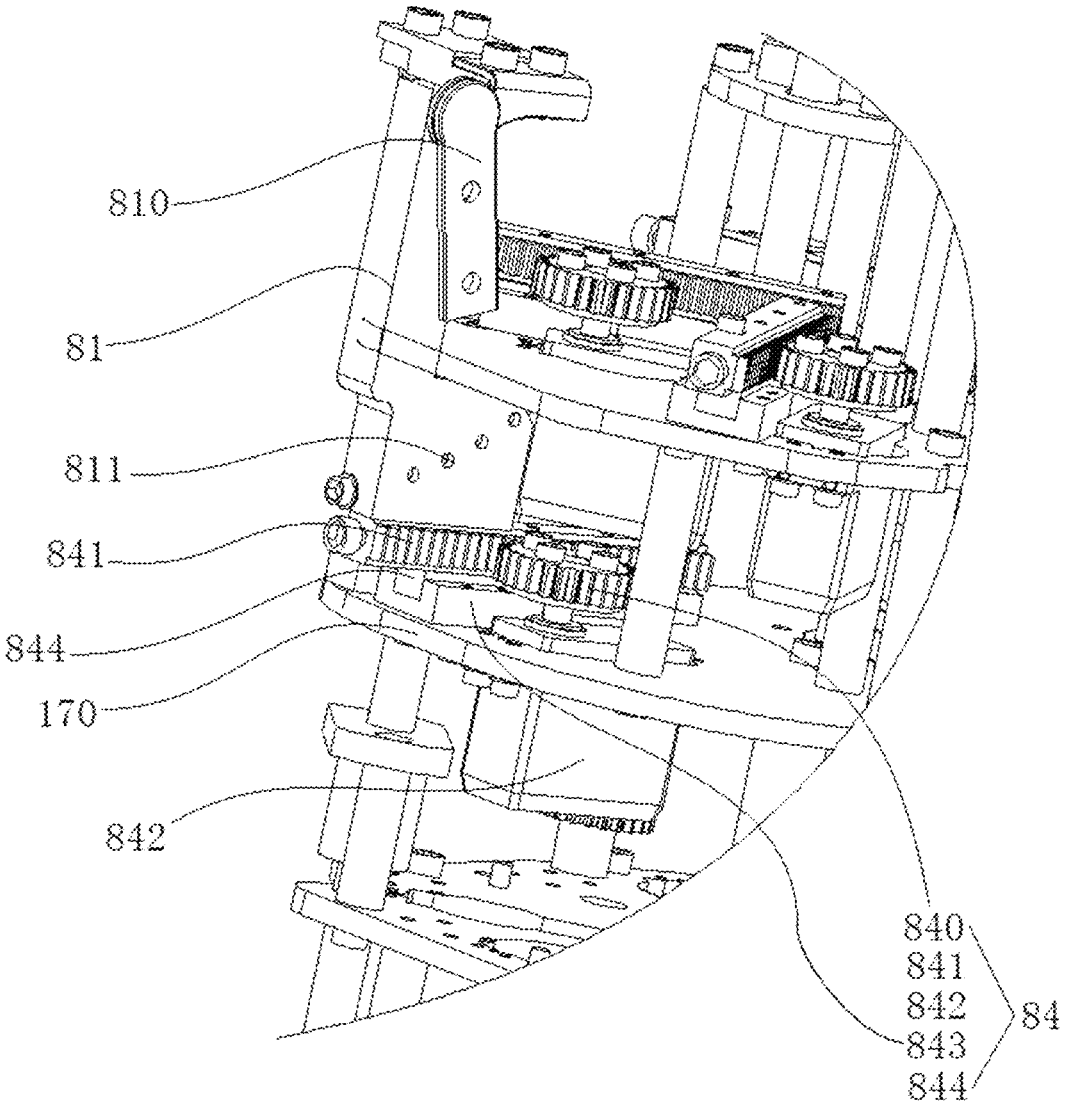
FIG. 11 is a partial enlarged view of the yawing device in the second embodiment of the present utility model.

As specifically shown in FIG. 10 to FIG. 11, the yawing bracket 81 is arranged in the vertical direction, and the top of the yawing bracket 81 is provided with a connecting plate 810. The connecting plate 810 is hinged with the yawing bracket 81, and the connecting plate 810 may swing laterally to the side of the body relative to the yawing bracket 81. A bracket fixing seat 803 is arranged on the inner surface of the top of the upper limb fixing seat 80, and the connecting plate 810 is fixedly connected with the bracket fixing seat 803. The bottom of the inner surface of the upper limb fixing seat 80 is provided with a fixing groove 804 for the regulating piece, and the regulating piece 82 is fixedly arranged in the fixing groove 804 for the regulating piece. The yawing bracket 81, the upper limb fixing seat 80 and the regulating piece 82 integrally form a crank-slider structure, wherein the yawing bracket 81 serves as a frame, the upper limb fixing seat 80 serves as a crank, the regulating piece 82 serves as a connecting rod, and the driving member is the regulating piece 82. The movement of the regulating piece 82 can drive the upper limb fixing seat 80 to rotate relative to the yawing bracket 81, thereby achieving the purpose of driving the upper limb 8 to swing laterally.

As shown in FIG. 10 and FIG. 11, the bottom of the yawing bracket 81 is provided with a yawing fixing seat 812, and the yawing device further includes a gear mechanism for controlling the movement amount of the regulating piece 82. The gear mechanism includes a first gear regulating hole 821 arranged at the inner end of the regulating piece 82 (one end close to the yawing bracket 81), a plurality of second gear regulating holes 811 arranged on the side wall of the yawing fixing seat 810, and a gear regulating bolt 83 which can pass through the first gear regulating hole 821 and the second gear regulating hole 811 so as to connect the regulating piece 82 with the yawing fixing seat 812. The regulating piece 82 changes the assembly position by changing to a different second gear regulating hole 811 through the gear regulating bolt 83, thereby realizing the control of the movement amount thereof. When the regulating piece 82 is assembled with the innermost second gear regulating hole 811, the upper limb 8 is in a folded state, and when the regulating piece 82 is assembled with the outermost second gear regulating hole 811, the upper limb 8 is in a state with the largest expansion range.

As shown in FIG. 10 to FIG. 11, every time the angle of lateral swing of the upper limb 8 is adjusted, the assembly position of the regulating piece 82 should be changed, which is achieved by changing to a different second gear regulating hole 811. For the convenience of operation, the torso 2 is further provided therein with an upper limb translation mechanism 84, and the upper limb translation mechanism 84 is used to push the yawing bracket 81 out of the torso 2, thereby exposing the yawing fixing seat 812 and the regulating piece 82 to the outside of the torso 2, and increasing the operable space.

The upper limb translation mechanism 84 includes a translation rack 841 fixedly arranged in the torso 2, a translation gear 840 matched with the translation rack 841, and a translation driving mechanism for driving the translation gear 840 to rotate. The translation driving mechanism is a translation motor 842, and the translation rack 841 is fixedly connected with the yawing fixing seat 812. In this way, when the translation rack 841 moves, it will push the yawing bracket 81 to move to the outside or inside of the torso 2, so that the whole yawing device can be moved out of or into the torso 2.

The torso 2 is provided therein with an upper limb regulating and mounting table 170 fixedly connected with the support frame 20, and the upper limb translation mechanism is fixedly arranged on the surface of the upper limb regulating and mounting table 170. The upper limb translation mechanism further includes an upper limb translation guide rail 843 fixedly arranged on the surface of the upper limb regulating and mounting table 170, and an upper limb translation slider 844 matched with the upper limb translation guide rail 843. The translation rack 841 is fixedly connected with the upper limb translation slider 844. When the translation gear 840 rotates, the translation rack 841 will follow the upper limb translation slider 844 to slide along the upper limb translation guide rail.

Figure 12:
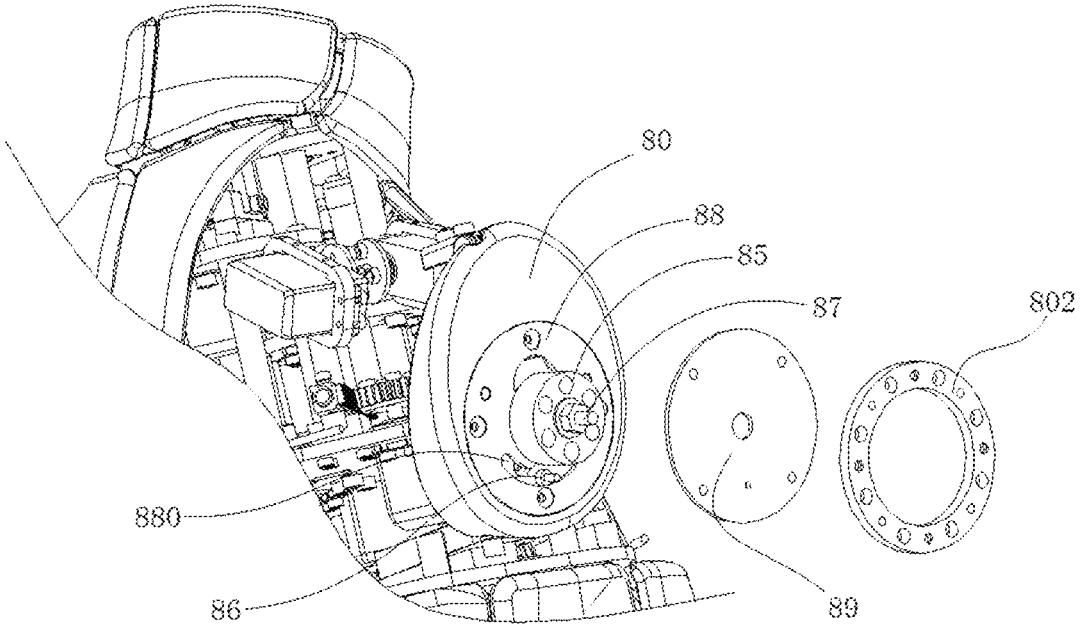
FIG. 12 is a partial enlarged view of the pitching device in the second embodiment of the present utility model.
Figure 13:
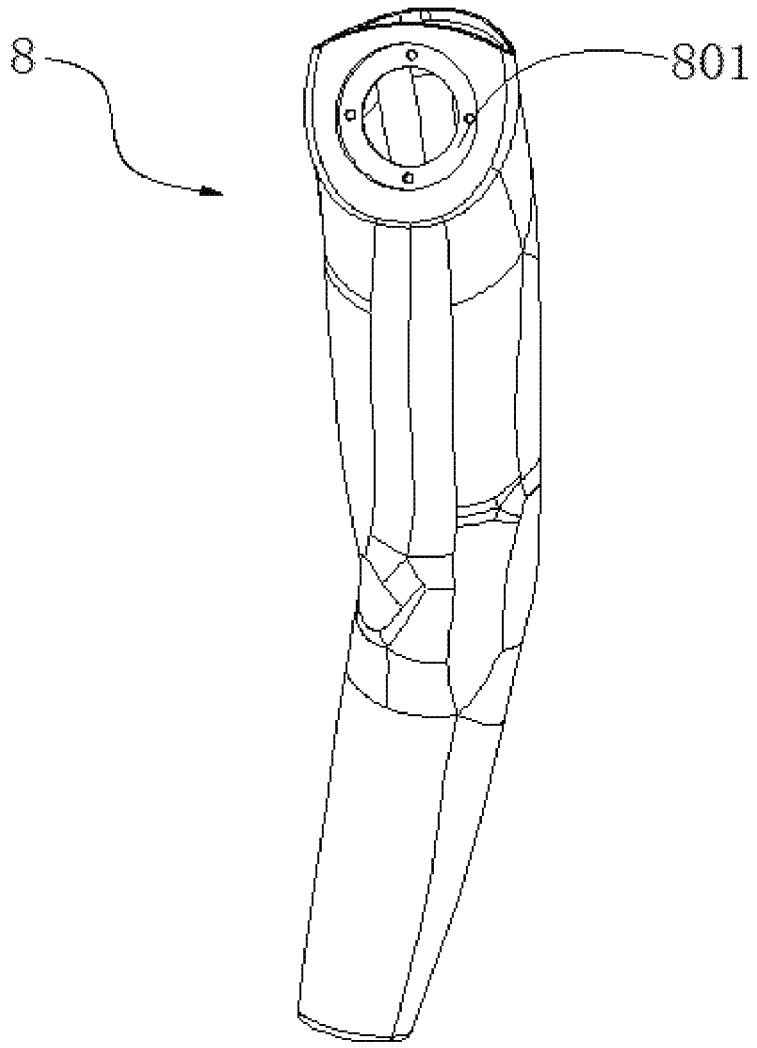
FIG. 13 is a schematic structural diagram of an upper limb in the second embodiment of the present utility model.

As shown in FIG. 12 to FIG. 13, a pitching device is further provided, which is used to control the upper limb 8 to swing longitudinally (swing back and forth) at the side of the torso 2. The pitching device includes a swing arm rotating shaft 85 fixedly connected with the upper limb fixing seat 80, and a swing arm bolt 86 for connecting the upper limb fixing seat 80 with the root of the upper limb 8. The root of the upper limb 8 is provided with an upper limb shaft sleeve 801 matched with the swing arm rotating shaft 85, and the outer side of the upper limb fixing seat 80 is further provided with a swing arm limiter. When the upper limb 8 rotates around the swing arm rotating shaft 85, the swing arm bolt 86 cooperates with the swing arm limiter to limit the swing angle of the upper limb 8.

Specifically, as shown in FIG. 12 to FIG. 15, the swing arm limiter is a pad 88 fixedly connected with the outer surface of the upper limb fixing seat 80, the end surface of the pad 88 is opened with an arc-shaped groove 880 concentric with the swing arm rotating shaft 85, the end of the swing arm bolt 86 passes through the arc-shaped groove 880 from the inner side of the pad 88 and is fixedly connected with the root of the upper limb 8, and the root of the swing arm bolt 86 is limited to slide in the arc-shaped groove 880. The outer surface of the upper limb fixing seat 80 is further provided with an avoidance groove 800 for avoiding the tail of the swing arm bolt 86. The pad 88 is sleeved on the swing arm rotating shaft 85 and fixedly connected with the outer surface of the upper limb fixing seat 80 through bolts. The swing arm bolt 86 can drive the upper limb 8 to slide in the arc-shaped groove 880, thereby realizing the longitudinal swing of the upper limb 8.

Figure 14:
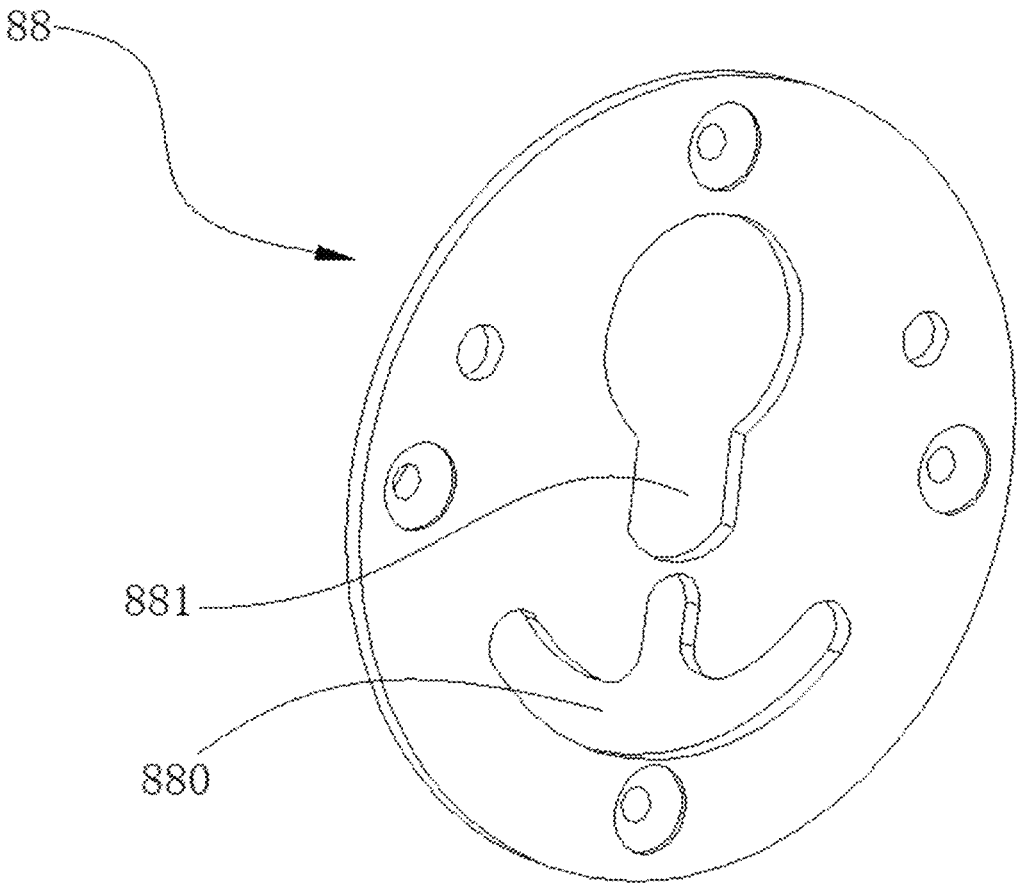
FIG. 14 is a schematic structural diagram of a pad in the second embodiment of the present utility model.
Figure 15:
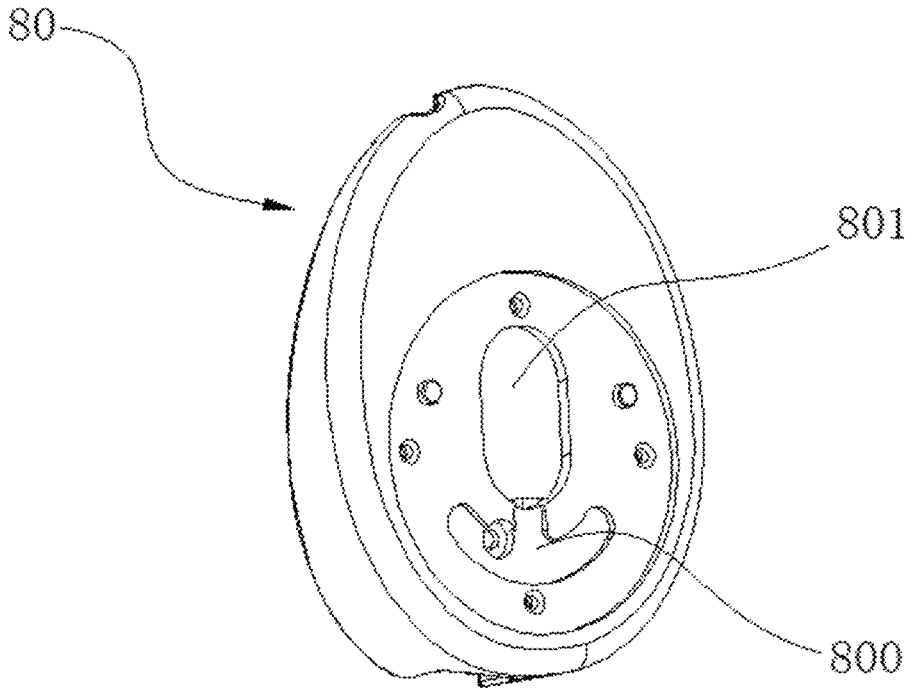
FIG. 15 is a schematic structural diagram of an upper limb fixing seat in the second embodiment of the present utility model.
Figure 16:
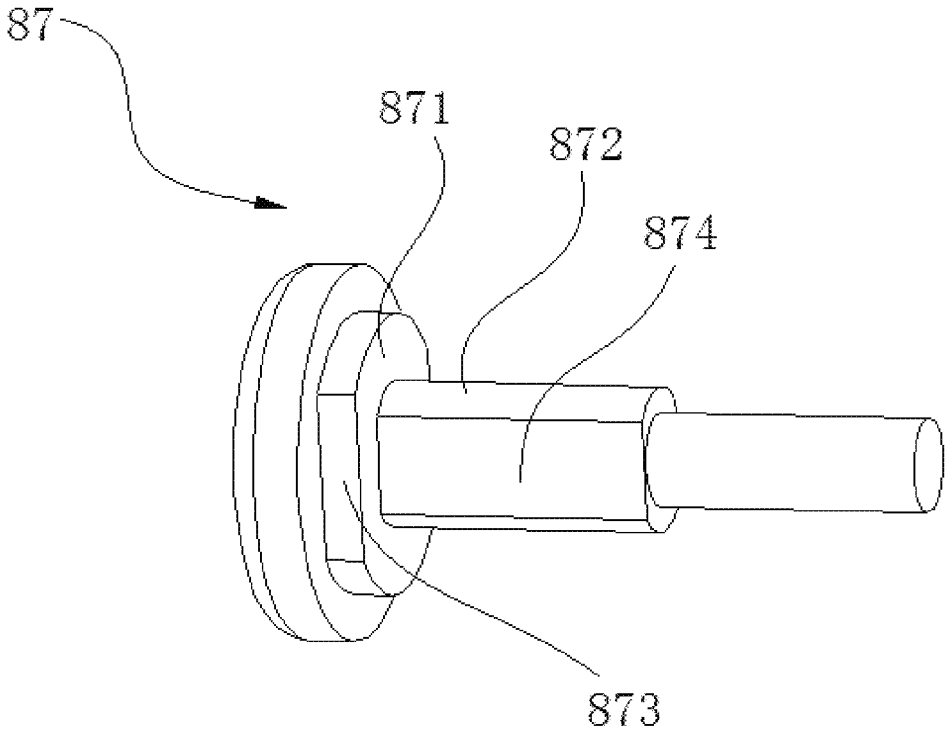
FIG. 16 is a schematic structural diagram of a swing arm bolt in the second embodiment of the present utility model.

As shown in FIG. 14 to FIG. 16, the pitching device further includes a rotating shaft fixing bolt 87 for fixing the swing arm rotating shaft 85 with the upper limb fixing seat 80. The rotating shaft fixing bolt 87 passes through the upper limb fixing seat 80 from the inner end of the upper limb fixing seat 80, and the tail of the rotating shaft fixing bolt 87 is retained at the inner side of the upper limb fixing seat 80. A first bolt body 871 for passing through the upper limb fixing seat 80 is arranged near the tail of the rotating shaft fixing bolt 87, a first waist-shaped hole 802 for the first bolt body 871 to pass through is arranged at the center of the upper limb fixing seat 80, a second waist-shaped hole 881 for the first bolt body 871 to pass through is arranged at the center of the pad 88, and a first flat position 873 for fitting with the first waist-shaped hole 801 and the second waist-shaped hole 881 is arranged on the side surface of the first bolt body 871. The first flat position 873 can prevent the self-rotation of the rotating shaft fixing bolt 87. The pad 88 is located between the swing arm rotating shaft 85 and the upper limb fixing seat 80, and a gasket 89 is further arranged between the pad 88 and the swing arm rotating shaft 85.

A second bolt body 872 for axially penetrating the swing arm rotating shaft 85 is arranged near the end of the rotating shaft fixing bolt 87, a third waist-shaped hole 850 for the second bolt body 872 to pass through is arranged at the center of the swing arm rotating shaft 85, and a second flat position 874 for fitting with the third waist-shaped hole 850 is arranged on the surface of the second bolt body 872. The engagement of the third waist-shaped hole 850 and the second flat position 874 prevents relative rotation between the swing arm rotating shaft 85 and the rotating shaft fixing bolt 87. The end of the rotating shaft fixing bolt 87 passes through the swing arm rotating shaft 85, and then is fixed by a nut 875 matched with the end, thereby fixedly connecting the swing arm rotating shaft 85 with the upper limb fixing seat 80.

The upper limb shaft sleeve 801 is integrally formed with the root of the upper limb 8, and the outer end of the upper limb shaft sleeve 801 is further provided with a connecting flange 802 which is fixedly connected with the upper limb fixing seat 80.

In this embodiment, the swing arm rotating shaft 85 is a damping member. When the pitching angle of the upper limb 8 is well adjusted, the swing amplitude of the upper limb 8 at this angle can be kept unchanged by the friction between the swing arm rotating shaft 85 and the shaft sleeve 801. When the swing amplitude needs to be changed, we only need to rotate the upper limb 8 actively.

The mannequin disclosed in this embodiment can adjust both the longitudinal swing and lateral swing of the upper limbs, and furthermore, it features a simple structure and convenient operation.

Third Embodiment

Shapes, widths as well as slopes of shoulders of human body vary greatly from person to person. Some people have shoulders with tall and straight shapes, while others have sloping shoulders with larger slopes. The shoulders of existing mannequins are often neglected, and most of them adopt standard fixed shapes. Such mannequins are only suitable for common clothing design and display, and they cannot be used for refined customization for specific goals, and thus cannot achieve the best effect of clothing customization depending on actual needs of individuals.

To solve this problem, this embodiment discloses a mannequin, and this embodiment can be implemented separately or as an improved scheme of the first embodiment and the second embodiment.

Figure 17:
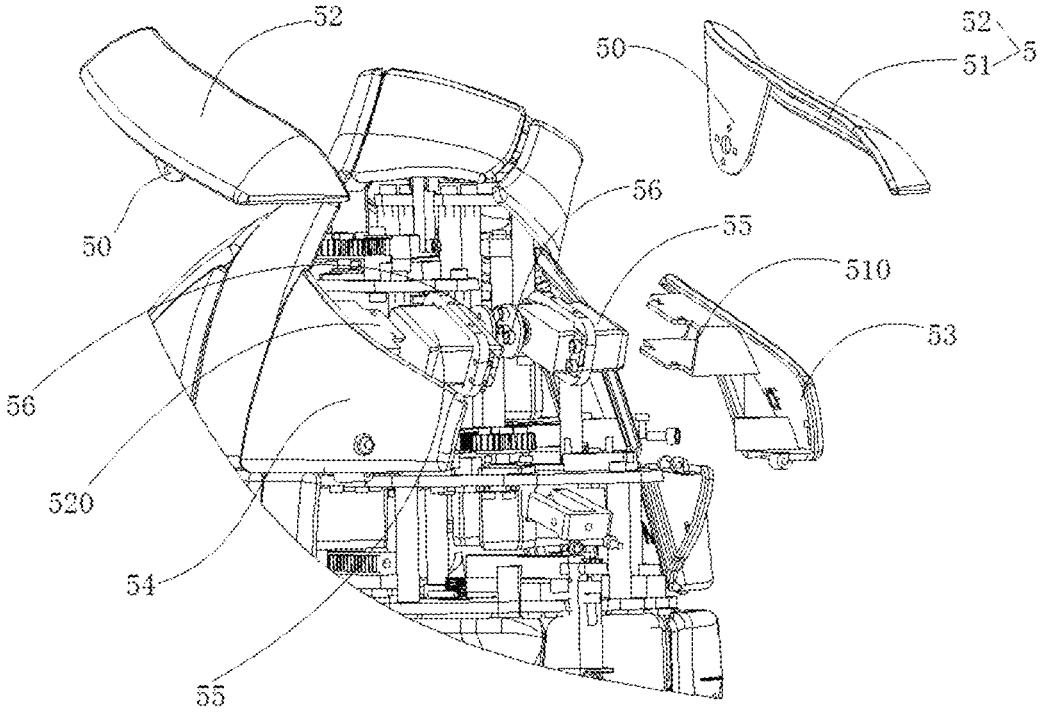
FIG. 17 is a schematic structural diagram of a shoulder shape regulating device in a third embodiment of the present utility model.

As shown in FIG. 17, the mannequin disclosed in this embodiment includes a torso 2, and the shoulder of the torso 2 is provided with a shoulder plate 5 for regulating the shape of the shoulder hump, and a shoulder shape regulating device for controlling the rotation of the shoulder plate 5. The torso 2 is provided therein with a shoulder plate fixing frame for fixing the shoulder plate 5 and the shoulder plate regulating device.

Specifically, as shown in FIG. 17, the shoulder plate 5 includes a front shoulder movable plate 51 and a rear shoulder movable plate 52, and the torso 2 is provided with a clavicle plate 53 and a scapula plate 54 at places respectively corresponding to the clavicle and the scapula of the human body, and the clavicle plate 53 and the scapula plate 54 can move in the direction close to or away from the support frame 20 (that is, the clavicle plate 53 corresponds to a driving plate in the main regulating band 21 to which the cervicothoracic region 12 belongs in the first embodiment, and the scapula plate 54 is a driving plate in the back circumference region 17). The shoulder fixing frame includes a front shoulder fixing frame 510 for fixing the front shoulder movable plate 51, and a rear shoulder fixing frame 520 for fixing the rear shoulder movable plate 52. The front shoulder fixing frame 510 is fixedly arranged on the inner side of the clavicle plate 53, and the rear shoulder fixing frame 520 is fixedly arranged on the inner side of the scapula plate 54. The shoulder shape regulating device includes a shoulder shape regulating motor 55. The front shoulder fixing frame 510 and the rear shoulder fixing frame 520 are respectively fixedly provided with a shoulder shape regulating motor 55, the inner surface of the root of the shoulder plate 5 is provided with a shoulder plate connecting seat 50, and the output shaft of the shoulder shape regulating motor 55 is fixedly connected with the shoulder plate connecting seat 50 of the corresponding shoulder plate 5 through a flange 56.

In this embodiment, the width, i.e., the thickness, of the shoulder of the mannequin can be adjusted by controlling the movement of the clavicle plate 53 and the scapula plate 54, and the shape of the shoulder hump can be adjusted by controlling the rotation of the shoulder plate by the shoulder shape regulating motor 55.

Fourth Embodiment

Once the female mannequin leaves the factory; the size of cup thereof cannot be changed. In order to simulate different breast shapes, the existing female mannequin has been improved accordingly. Generally, the plate at the breast of the female body that corresponds to the cup is made into a driving plate that can move relative to the support frame, and the breast shape of the mannequin is adjusted by regulating the movement of the movable plate at the cup. However, this kind of mannequin can only change the position of the breast but cannot change the size of the breast of the mannequin. Therefore, the existing mannequins cannot simulate the real effects of different sizes of cups, and the degree of refinement is low, and thus they cannot achieve clothing customization depending on actual needs of individuals.

To solve this problem, this embodiment discloses a mannequin of which the size of the cup can be changed. This embodiment can be used as a separate embodiment, or as an improved scheme of the first embodiment, the second embodiment and the third embodiment.

Figure 18:
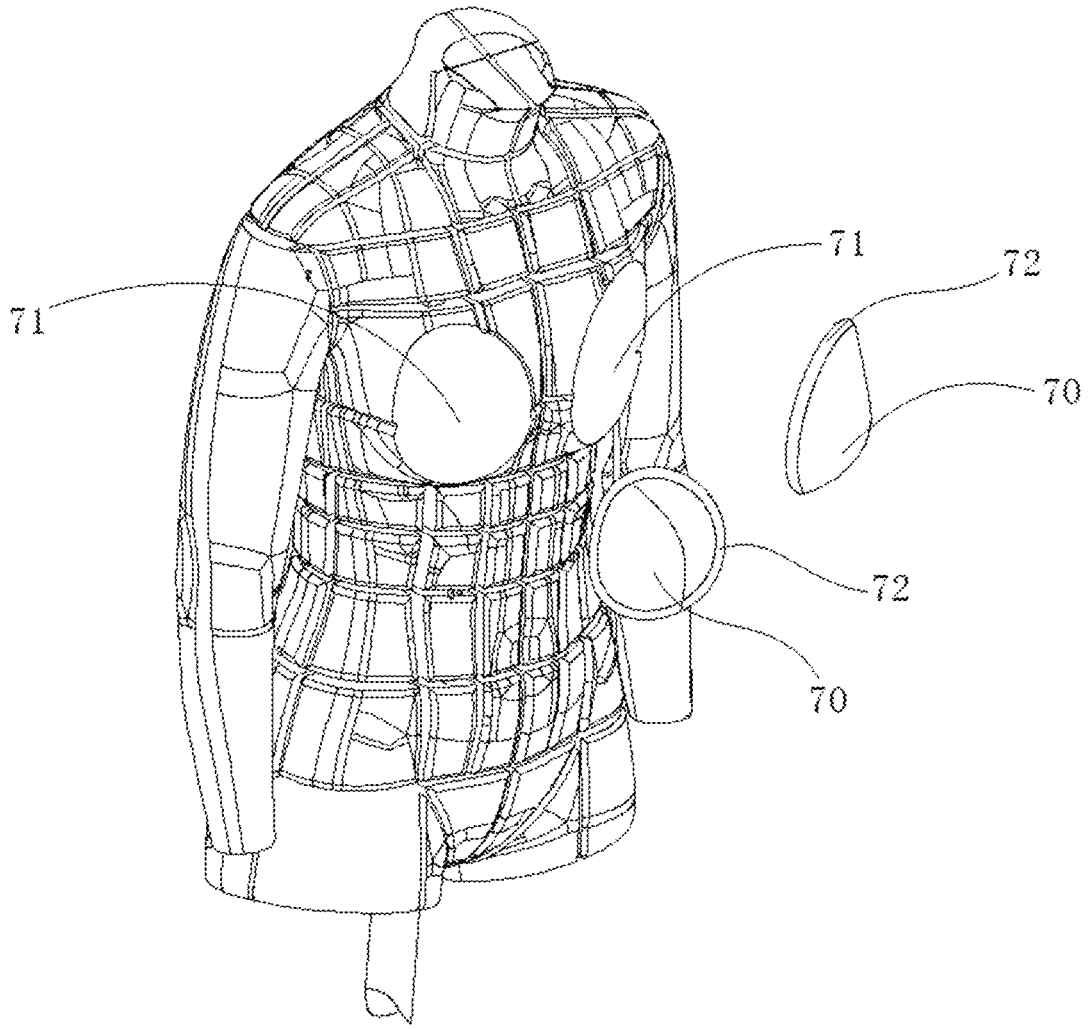
FIG. 18 is a schematic view of the exploded structure of a mannequin in a fourth embodiment of the present utility model.

As shown in FIG. 18, the mannequin disclosed in this embodiment includes a torso 2, and a cup prosthesis 70 that can be detachably connected is provided on the torso 2 at the place corresponding to the breast of the human body. The torso 2 is provided with a first magnetic piece 71 at the place corresponding to the breast of the human body, and the bottom of the cup prosthesis 70 is provided with a second magnetic piece 72. The cup prosthesis 70 can be detachably connected by mutual attraction between the first magnetic piece 71 and the second magnetic piece 72.

By adopting such a structural design, cups of different sizes can be quickly replaced, the structure is simple, and the operation is convenient. Therefore, refined design of cup sizes can be realized to really accomplish clothing customization depending on actual needs of individuals.

It shall be noted that, the specification and attached drawings of the present utility model show preferred embodiments of the present utility model. However, the present utility model can be implemented in many different forms, and it is not limited to the embodiments described in this specification. These embodiments are not construed as additional restrictions on the content of the present utility model, but are provided for a more thorough and comprehensive understanding of the disclosure of the present utility model. In addition, the above technical features continue to be combined with each other to form various embodiments not listed above, all of which are regarded as within the scope described in the specification of the present utility model. Further speaking, those of ordinary skill in the art can make improvements or variations according to the above description, and all these improvements and variations shall fall within the scope claimed in the appended claims of the present utility model.

What is claimed is:

1. A mannequin comprising:

a torso;

upper limbs on both lateral sides of the torso;

an upper limb fixing seat being arranged at a root of each upper limb;

a yawing device used for regulating a lateral swing of a respective upper limb being arranged at a joint between that upper limb and the torso;

wherein the yawing device comprises:

a yawing bracket fixed in the torso;

a regulating piece, wherein an inner end of the regulating piece is movable relative to a bottom of the yawing bracket;

wherein a top of the yawing bracket is hinged with a top of the upper limb fixing seat, an outer end of the regulating piece is fixedly connected with the yawing bracket, and a movement of the regulating piece is used to drive the top of the respective upper limb fixing seat to swing relative to the yawing bracket, thereby driving the upper limb to swing laterally;

wherein the yawing device further comprises a gear mechanism for controlling the movement of the regulating piece and the gear mechanism comprises a first gear regulating hole arranged at the inner end of the regulating piece, and a plurality of second gear regulating holes arranged at the bottom of the yawing bracket for changing an assembly position of the first gear regulating hole, and the plurality of second gear regulating holes are distributed at intervals along a moving trajectory of the regulating piece.

2. The mannequin according to claim 1, wherein the torso is further provided therein with an upper limb translation mechanism for pushing the yawing bracket out of the torso;

the upper limb translation mechanism comprises a translation rack fixedly arranged in the torso, a translation gear matched with the translation rack, and a translation driving mechanism for driving the translation gear to rotate so as to drive the translation rack to laterally move outward, and the translation rack is fixedly connected with the bottom of the yawing bracket.

3. The mannequin according to claim 1, wherein the mannequin further comprises:

a pitching device for the upper limb to swing longitudinally at one lateral side of the torso, wherein the pitching device comprises:

a swing arm rotating shaft fixedly connected with the upper limb fixing seat, and a swing arm bolt for connecting the upper limb fixing seat with the root of the upper limb;

wherein the root of the upper limb is provided with a shaft sleeve matched with the swing arm rotating shaft, an outer side of the upper limb fixing seat is further provided with a guiding element for the swing arm bolt to slide in an arc trajectory around the swing arm rotating shaft, and the guiding element restricts the separation of the swing arm bolt from the upper limb fixing seat in an axial direction;

wherein the guiding element is a pad fixedly connected with the outer surface of the upper limb fixing seat, an end face of the pad is provided with an arc-shaped groove concentric with the swing arm rotating shaft, an end of the swing arm bolt passes through the arc-shaped groove from an inner side of the pad and is fixedly connected with the root of the upper limb, and the swing arm bolt is capable of sliding in the arc-shaped groove.

4. The mannequin according to claim 3, wherein the pitching device further comprises:

a rotating shaft fixing bolt for fixing the swing arm rotating shaft with the upper limb fixing seat, a first bolt body for penetrating the upper limb fixing seat is arranged near a tail of the rotating shaft fixing bolt, a first waist-shaped hole and a second waist-shaped hole for the first bolt body to pass through are respectively arranged at a center of the upper limb fixing seat and the pad, and a side surface of the first bolt body is provided with a first flat position for fitting with the first waist-shaped hole and the second waist-shaped hole.

5. The mannequin according to claim 4, wherein a second bolt body for axially penetrating the swing arm rotating shaft is arranged near an end of the rotating shaft fixing bolt, a third waist-shaped hole for the second bolt body to pass through is arranged at a center of the swing arm rotating shaft, and a surface of the second bolt body is provided with a second flat position for fitting with the third waist-shaped hole.

6. The mannequin according to claim 1, wherein the torso is provided with a first magnetic device at a place corresponding to a human chest; and the torso further comprises a cup prosthesis which is movably connected with the torso, and a root of the cup prosthesis is provided with a second magnetic device that is matched with the first magnetic device.

* * * * *